US010504422B2

(12) United States Patent
Cheng et al.

(10) Patent No.: US 10,504,422 B2
(45) Date of Patent: Dec. 10, 2019

(54) COMPENSATION CIRCUIT AND DISPLAY PANEL

(71) Applicant: Au Optronics Corporation, Hsinchu (TW)

(72) Inventors: Mao-Hsun Cheng, Tainan (TW); Cheng-Han Huang, Hsinchu (TW); Wei-Ting Wu, Hsinchu (TW); Yung-Chih Chen, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/223,111

(22) Filed: Dec. 18, 2018

(65) Prior Publication Data

US 2019/0237006 A1 Aug. 1, 2019

(30) Foreign Application Priority Data

Jan. 30, 2018 (TW) ..... 107103335 A

(51) Int. Cl.
*G09G 3/32* (2016.01)

(52) U.S. Cl.
CPC ..... *G09G 3/32* (2013.01); *G09G 2300/0819* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 7,199,771 | B2 | 4/2007 | Yamazaki et al. | |
| 7,688,291 | B2 | 3/2010 | Yamazaki et al. | |
| 8,497,828 | B2 | 7/2013 | Chaji et al. | |
| 8,558,767 | B2 | 10/2013 | Kwon | |
| 8,558,825 | B2 | 10/2013 | Bae et al. | |
| 8,810,556 | B2 | 8/2014 | Lee et al. | |
| 9,591,715 | B2 | 3/2017 | Gai et al. | |
| 9,691,348 | B2 | 6/2017 | Kim et al. | |
| 2003/0063053 | A1 | 4/2003 | Yamazaki et al. | |
| 2007/0097038 | A1 | 5/2007 | Yamazaki et al. | |
| 2008/0136338 | A1 | 6/2008 | Troccoli et al. | |
| 2010/0188320 | A1* | 7/2010 | Min | G09G 3/3291 345/80 |
| 2011/0122119 | A1 | 5/2011 | Bae et al. | |
| 2016/0286622 | A1 | 9/2016 | Gai et al. | |
| 2018/0342199 | A1* | 11/2018 | Zhou | G09G 3/32 |

FOREIGN PATENT DOCUMENTS

| | | |
|---|---|---|
| CN | 104658485 | 3/2017 |
| TW | 565820 | 12/2003 |
| TW | 201009793 | 3/2010 |
| TW | 201137828 | 11/2011 |

* cited by examiner

*Primary Examiner* — Nicholas J Lee
(74) *Attorney, Agent, or Firm* — JCIPRNET

(57) ABSTRACT

A display panel and a compensation circuit are provided. The display panel has a periphery region and a display region. The display panel includes pixel columns and a threshold voltage compensation circuit. The pixel columns are disposed in the display region. The threshold voltage compensation circuit is disposed in the periphery region. The threshold voltage compensation circuit receives a compensation voltage, outputs threshold voltage information of a compensation transistor based on the compensation voltage, and generates compensated display data based on the threshold voltage information and display data.

12 Claims, 11 Drawing Sheets

COMPENSATION CIRCUIT AND DISPLAY PANEL

CROSS-REFERENCE TO RELATED APPLICATION

This application claims the priority benefit of Taiwan application serial no. 107103335, filed on Jan. 30, 2018. The entirety of the above-mentioned patent application is hereby incorporated by reference herein and made a part of this specification.

BACKGROUND OF THE INVENTION

1. Field of the Invention

The invention relates to a light emitting diode compensation circuit and a display panel, and particularly relates to a compensation circuit adapted to compensate a threshold voltage in a non-display region and a display panel.

2. Description of Related Art

With the progress of technology, light emitting diodes (LEDs) have been broadly applied in display technologies. Also, active-matrix organic light emitting diodes (AMOLED) have become a key aspect in the development of display technologies. During the manufacturing process of an AMOLED display panel, an excimer-laser annealing (ELA) process may be performed to manufacture a low temperature polycrystalline silicon thin film transistor (LTPS-TFT) device on the AMOLED display panel.

However, the power of each excimer laser output may differ in the ELA process. Therefore, the LTPS-TFT devices on a display panel may have non-uniform electrical properties, and frames displayed may be affected and also non-uniform.

For example, during the ELA process performed on the LTPS-TFT devices of a display panel, when the excimer laser scans one column after another, the LTPS-TFT devices of the same column may substantially have the same electrical properties. For example, threshold voltages of the LTPS-TFT devices of the same column may be the same. However, since the powers of respective excimer laser outputs may differ, the LTPS-TFT devices of the respective columns may have different electrical properties, such as different threshold voltages.

Thus, how to compensate the electrical properties during the manufacturing process of the LPTS-TFT devices has become an issue to facilitate the display uniformity of the AMOLED display panel.

SUMMARY OF THE INVENTION

One or some exemplary embodiments of the invention provide a threshold voltage compensation circuit and a display panel capable of facilitating the display uniformity of a display panel.

A display panel according to an embodiment of the invention has a periphery region and a display region. The display panel includes a pixel column, a threshold voltage compensation circuit, and an operator. The pixel column is disposed in the display region and has a plurality of pixels coupled to a data line. The threshold voltage compensation circuit is disposed in the periphery region. The threshold voltage compensation circuit includes a threshold voltage detection circuit and an operator. The threshold voltage detection circuit is electrically coupled to the data line. The threshold voltage detection circuit includes a first transistor, a compensation transistor, and a second transistor. The first transistor has a first end, a second end, and a control end. The first end of the first transistor and the control end of the first transistor are configured to receive a compensation voltage. The compensation transistor outputs threshold voltage information of the compensation transistor based on the compensation voltage and has a first end, a second end, and a control end. The second end of the first transistor is coupled to the control end of the compensation transistor, the control end of the first transistor is coupled to the second end of the compensation transistor, and the first end of the compensation transistor is coupled to the control end of the compensation transistor; and The second transistor has a first end, a second end, and a control end. The first end of the compensation transistor is coupled to the first end of the second transistor. The operator is electrically coupled to the threshold voltage detection circuit and configured to generate compensated display data based on the threshold voltage information and display data.

A threshold voltage compensation circuit according to an embodiment of the invention is disposed in a periphery region. The threshold voltage compensation circuit includes a threshold voltage detection circuit and an operator. The threshold voltage detection circuit is electrically coupled to a data line of the display panel. The threshold voltage detection circuit includes a first transistor, a compensation transistor, and a second transistor. The first transistor has a first end, a second end, and a control end. The first end of the first transistor and the control end of the first transistor are configured to receive a compensation voltage. The compensation transistor outputs threshold voltage information of the compensation transistor based on the compensation voltage. The compensation transistor has a first end, a second end, and a control end. The second end of the first transistor is coupled to the control end of the compensation transistor, the control end of the first transistor is coupled to the second end of the compensation transistor, and the first end of the compensation transistor is coupled to the control end of the compensation transistor. The second transistor has a first end, a second end, and a control end. The first end of the compensation transistor is coupled to the first end of the second transistor. The operator is electrically coupled to the threshold voltage detection circuit and configured to generate compensated display data based on the threshold voltage information and display data.

Generally, in the threshold voltage compensation circuit according to the embodiments of the invention, the compensation transistor is reset and outputs the threshold voltage information, and the operator receives the threshold voltage information and computes based on the threshold voltage information and the display data to generate the compensated display data. Accordingly, the threshold voltages of the each pixel columns may be compensated based on the compensated display data, so as to effectively facilitate the display uniformity of the display panel.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In the following, the principle of the disclosure will be described with the accompany drawings and detailed description. After learning the embodiments of the disclosure, people of ordinary skills in the art may change and modify the technology taught in the disclosure without departing from the spirit and scope of the disclosure.

Regarding the terms such as "first", "second", and the like used hereinafter, such terms do not specifically denote a sequence or an order, and do not serve to limit the invention, either. These terms are merely used to distinguish among the same components or operations described with the same technical terms.

The term "electrically coupling/coupled" used hereinafter may refer to that two or more components in direct physical or electrical contact or that two or more components in indirect physical or electrical contact. Meanwhile, the term "electrically coupling/coupled" may also refer to that two or more components are operated or moved with respect to each other.

Terms such as "comprise", "have", "include", and/or the like used hereinafter should be considered as open-ended terms meaning "including but not limited to".

The term "and/or" used hereinafter covers any one of or all the combinations of the described components.

Unless specifically noted, terms used hereinafter mainly bear the general meanings used in the field, the disclosure, and special contents. Some terms used to describe the disclosure are discussed below or elsewhere in the specification to provide additional guidance on the descriptions of the disclosure for people skilled in the art.

Figure 1:
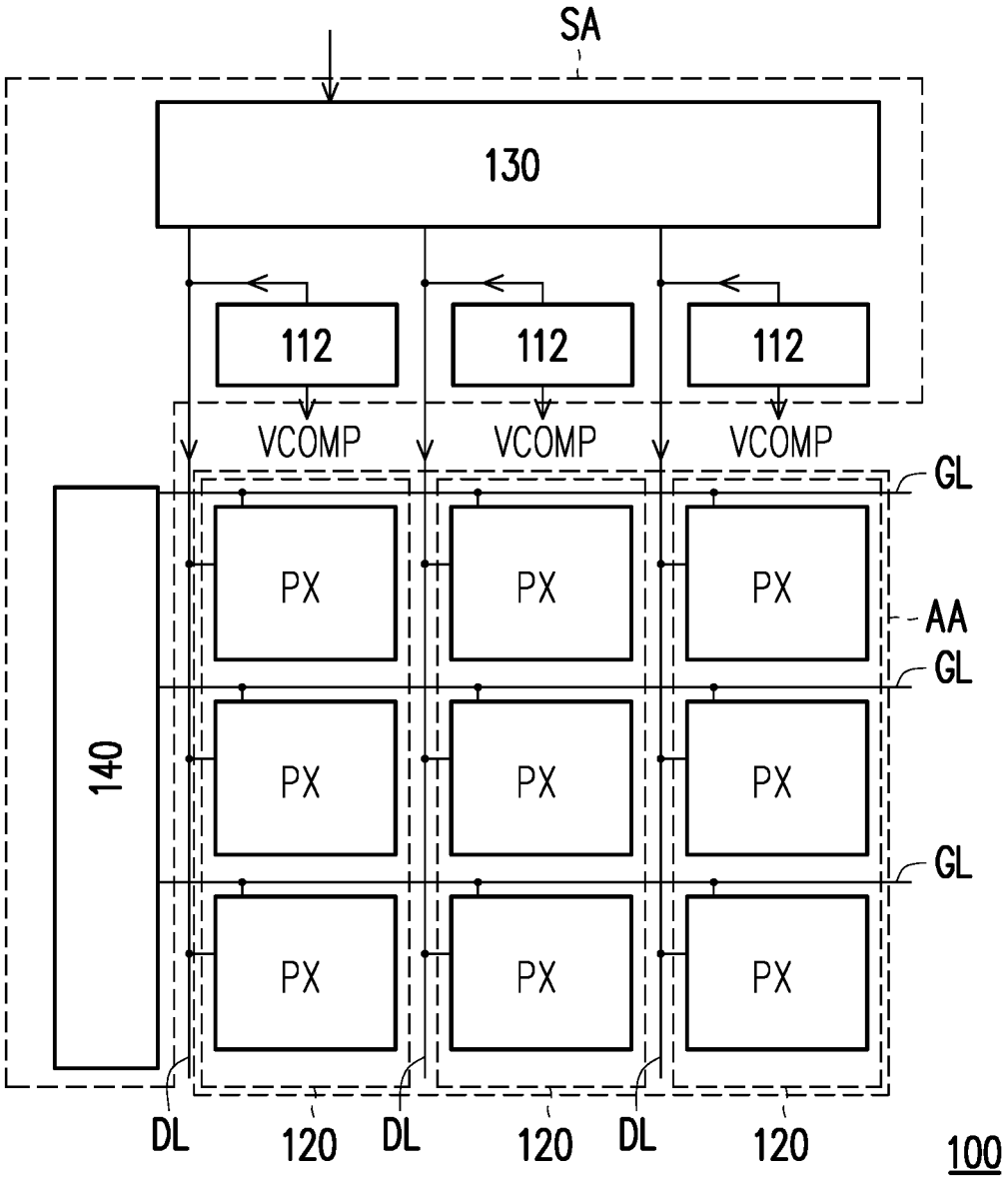
FIG. 1 is a schematic diagram illustrating a display panel according to an embodiment of the invention.

Referring to FIG. 1, FIG. 1 is a schematic diagram illustrating a display panel according to an embodiment of the invention. A display panel 100 may be an array substrate having low temperature polycrystalline silicon (LTPS) thin film transistors. In addition, the display panel 100 includes a periphery region SA and a display region AA. The display region AA includes a plurality of pixel circuits PX arranged into a matrix and configured to form a plurality of pixel columns 120 arranged in parallel. The periphery region SA may have a data driver 130, a scan driver 140, and a threshold voltage compensation circuit 110. In an embodiment of the invention, the data driver 130 may be formed by bonding an integrated circuit (IC) of the data driver 130 to the array substrate by performing a chip on glass (COG) process. The scan driver 140 may be directly formed on the array substrate in the form of a gate driver on array (GOA) circuit. However, the invention is not limited thereto. The data driver 130 is electrically coupled to a plurality of data lines DL. The data lines DL are disposed in correspondence with the corresponding pixel columns 120 to output data signals to the corresponding pixels PX. The scan driver 140 is electrically coupled to a plurality of scan lines GL. The scan lines GL are arranged in correspondence with the corresponding pixel columns in a direction different from that of the data lines DL, so as to output scan signals S(N) to the corresponding pixels PX.

Figure 2A:
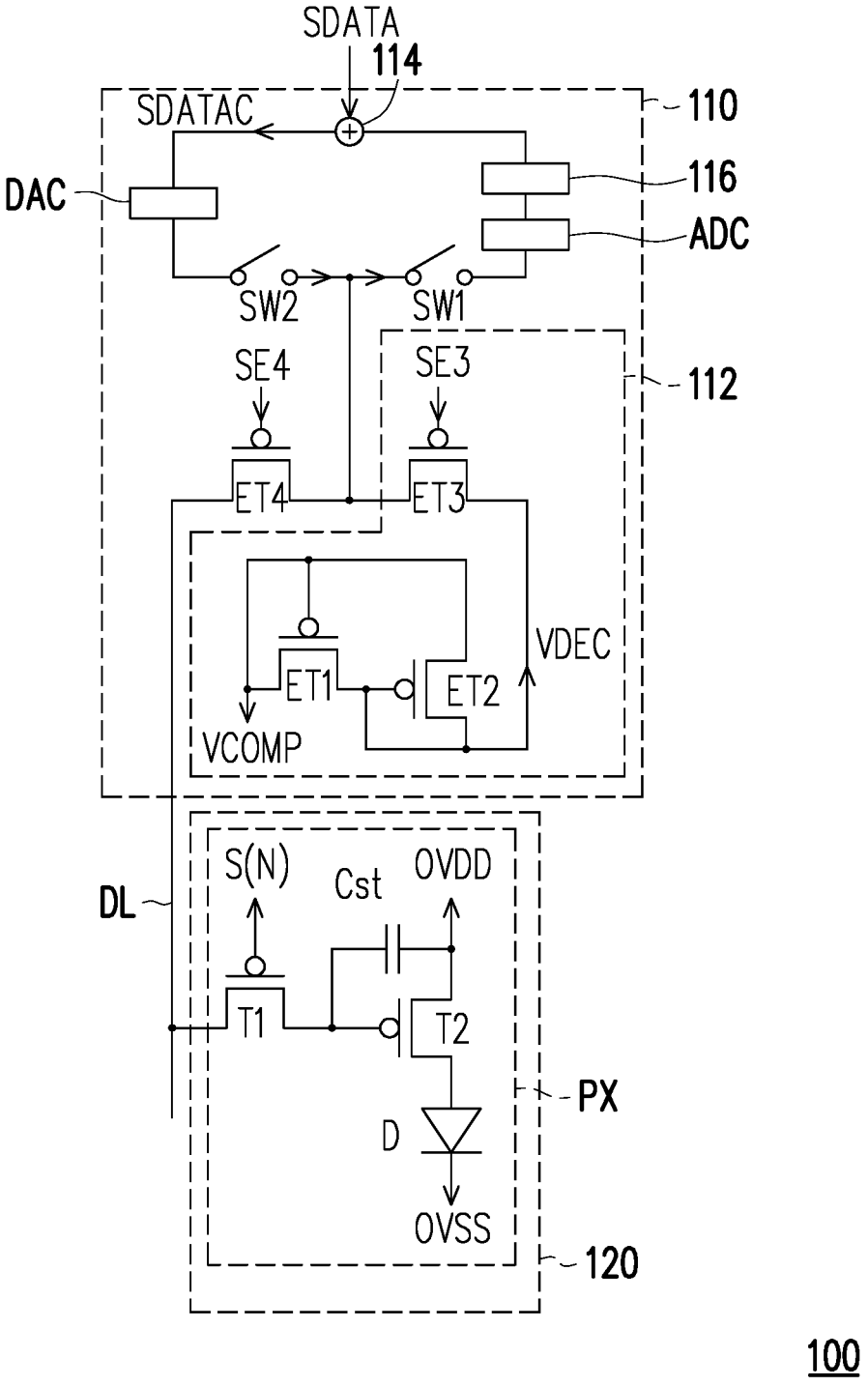
FIG. 2A is a schematic diagram illustrating a threshold voltage compensation circuit according to an embodiment of the invention.

Referring to FIGS. 1 and 2A, FIG. 2A is a schematic diagram illustrating a threshold voltage compensation circuit according to an embodiment of the invention. The threshold voltage compensation circuit 110 includes a threshold voltage detection circuit 112 and an operator 114. The threshold voltage compensation circuit 112 is disposed on the periphery region SA of the display panel 100. In addition, the threshold voltage detection circuit 112 is disposed in correspondence with the corresponding pixel column 120. In general, the threshold voltage detection circuit 112 may be electrically connected with pins of the pixel column 120 and the data driver 130. In another embodiment of the invention, the pin of the data driver 130 may be electrically connected to a threshold voltage detection circuit 112 via a demultiplexer (also referred to as MUX, not shown) to reduce the number of pins of the data driver 130 and thereby reduce the cost. However, the invention is not limited thereto, as long as each pixel column 120 has the corresponding threshold voltage detection circuit 112.

The threshold voltage detection circuit 112 receives a compensation voltage VCOMP and is configured to generate threshold voltage information VDEC to the operator 114 when the display panel 100 is booting, i.e., before the display panel 100 enters a frame period. The compensation voltage VCOMP may be an external signal from a timing controller (not shown). The threshold voltage detection circuit 112 includes a transistor ET1, a transistor ET2, and a transistor ET3. Each of the transistors includes a first end, a second end, and a control end. In addition, the first end of the transistor ET1 and the control end of the transistor ET1 are configured to receive the compensation voltage VCOMP. Namely, in the transistor ET1, the first end of the transistor ET1 and the control end of the transistor ET1 are connected via diode connection. The second end of the transistor ET1 is coupled to the control end of the transistor ET2, and the control end of the transistor ET1 is coupled to the second end of the transistor ET2. The first end of the transistor ET2 is coupled to the control end of the transistor ET2. In other words, in the transistor ET2, the first end of the transistor ET2 is connected to the control end of the transistor ET2 via diode connection. The first end of the transistor ET2 is coupled to the first end of the transistor ET3, and the second end of the transistor ET3 is coupled to the operator 114.

The operator 114 is electrically coupled to the transistor ET3 of the threshold voltage detection circuit 112 and is configured to receive the threshold voltage information VDEC from the threshold voltage detection circuit 112. In addition, the operator 114 may perform computation based on the threshold voltage information VDEC and display data SDATA to generate compensated display information SDATAC, and output a data voltage to the corresponding pixel column 120 during the frame period to enable the corresponding pixel PX. In an embodiment of the invention, for example, the operator 114 may be an adder incorporated in the data driver 130, and the threshold voltage information VDEC is received via the pin of the data driver 130. The threshold voltage compensation circuit 110 may further include an analog-to-digital converter ADC and a memory 116. The analog-to-digital converter ADC converts the received threshold voltage information VDEC from an analog signal to a digital signal, and temporarily stores the threshold voltage information VDEC in the memory 116. After the display data SDATA is received, the compensated display data SDATAC is generated through the adder unit. Then, a digital-to-analog converter DAC in the data driver 130 may convert the compensated display data SDATAC from a digital signal to an analog signal. The pin (not shown) of the data driver 130 outputs the data voltage. However, the invention is not limited thereto. Each of the operator 114, the analog-to-digital converter ADC, and the memory 116 may be disposed on an array substrate, a flexible printed circuit board (FCB), or be integrated in the data driver 130.

In another embodiment of the invention, the threshold voltage compensation circuit 110 may include a switch SW1 and a switch SW2 disposed in the data driver 130. The switch SW1 is connected between the pin (not shown) and the analog to digital converter ADC. Based on the timing in the data driver 130, the switch SW1 is turned on, and the threshold voltage information VDEC is received. The switch SW2 is coupled between the digital-to-analog converter DAC and the pin. Based on the timing in the data driver 130, the switch SW2 is turned on, and the data voltage is output. The switch SW1 and the switch SW2 may be switches formed in an integrated circuit in the form of a metal oxide semiconductor field effect transistor (MOSFET) or a transmission gate. However, the invention is not limited thereto.

In another embodiment of the invention, a transistor ET4 may be further disposed between the data driver 130 and the data line DL. Taking an embodiment of the invention as an example, since the pin receiving the threshold voltage information VDEC and the pin outputting the data voltage in the data driver 130 are shared, a first end of the transistor ET4 is coupled to the second end of the transistor ET3, a second end of the transistor ET4 is coupled to the data line DL, and a control end of the transistor ET4 receives a selection signal SE4. Based on the selection signal SE4, the transistor ET4 is turned on to output the data voltage to the data line DL. The transistors ET1 to ET4 and transistors T1 to T2 are P-type thin film transistors. However, the invention is not limited thereto. In another embodiment, the transistors ET1 to ET4 and the transistors T1 to T2 may also be N-type thin film transistors.

In an embodiment of the invention, each pixel PX may be a basic pixel circuit having two transistors and one capacitor (2T1C). The pixel PX includes the transistor T1, the transistor T2, a capacitor C2*t*, and a light emitting diode D. Each of the transistors has a first end, a second end, and a control end. The first end of the transistor T1 is coupled to the data line DL, the second end of the transistor T1 is coupled to the control end of the transistor T2, the first end of the transistor T2 is configured to receive a voltage OVDD, the second end of the transistor T2 is coupled to an anode of the light emitting diode D, the capacitor Cst may be coupled between the first end/second end of the transistor T2 and the control end, and a cathode of the light emitting diode is configured to receive a voltage OVSS. However, the invention is not limited thereto.

In a thermal treatment of the display panel 100, the display panel 100 may be subjected to an excimer-laser annealing (ELA) process sequentially scanning each of the columns. In other words, when the ELA process is performed on each column of the display panel 100 to carry out the thermal treatment, the transistors in the same column direction are subjected to the thermal treatment at the same time. Therefore, the threshold voltage detection circuit 112 and the pixel column 120 of the same column are subjected to the thermal treatment at the same time. Accordingly, the transistors in the same column may have substantially equal electrical properties. Namely, the threshold voltages of the transistors in the same column are substantially equal. Therefore, the threshold voltage of the transistor T2 (i.e., the driving transistor) of the pixel PX and the transistor ET2 of the threshold voltage detection circuit 112 may be considered as equal. According to an embodiment of the invention, during a blanking period without entering the frame period, the threshold voltage of the transistor is detected by the threshold voltage detection circuit 112 disposed in the periphery region SA, and computation on the threshold voltage information VDEC generated accordingly and the display data SDATA are carried out to generate the compensated display data SDATAC. During the frame period, the compensated display data SDATAC is written into the corresponding pixel PX. By disposing the threshold voltage detection circuit 112 in the periphery region SA, an aperture ratio of the pixel PX may be increased. In the known basic pixel circuit, the threshold voltage of the driving transistor of each pixel needs to be compensated during each pixel refresh period. Comparatively, since the embodiments of the invention disclose that the threshold voltage of the transistor is detected during the blanking period without entering the frame period, the time for threshold voltage detection is not affected by a refresh rate and a resolution of the display device. Thus, it is not necessary for the pixel PX to compensate the threshold voltage of the driving transistor during the pixel refresh period. Therefore, an emitting period of the pixel PX is lengthened.

Figure 2B:
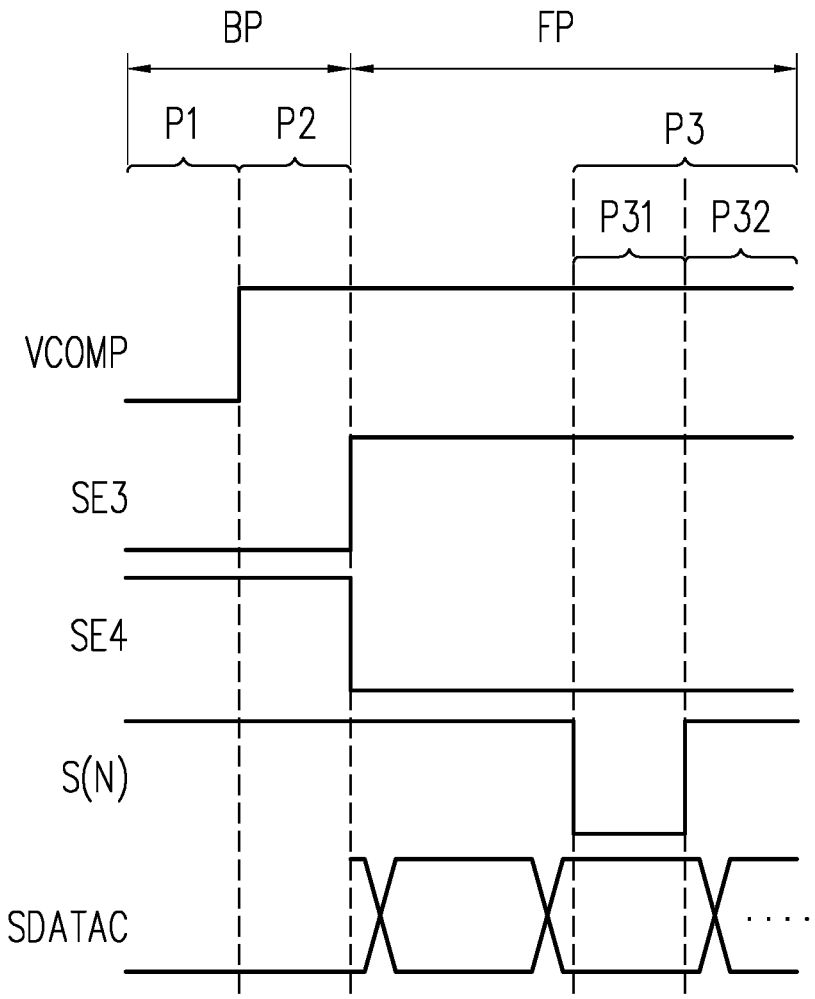
FIG. 2B is a timing diagram of a pixel PX according to an embodiment of the invention.

Referring to FIGS. 2A and 2B, FIG. 2B is a timing diagram according to the embodiment of FIG. 2A. The operational timing of the display panel may include a blanking period BP and a frame period FP. The blanking period BP may be divided into a reset period P1 and a preset period P2, and the frame period FP may include a plurality of pixel refresh periods P3 of the pixels in the pixel column 120. The blanking period BP may refer to a period when the display panel is booting or a period before the display panel enters the frame period. Since a timing controller is just turned on, the compensation voltage VCOMP has a low voltage level VL during the reset period. The compensation voltage VCOMP is turned from the low voltage level VL to a high voltage level VH during the preset period P2. In the frame period FP, the scan driver 140 may output scan signals S(1) to S(N) to the display panel 110 to refresh the pixels. In addition, each of the pixel update periods P3 includes a data writing period P31 when the pixel PX is turned on based on the scan signal S(N) for the data voltage to be written to the pixel PX and an emitting period P32. The selection signal SE4 has a high voltage level during the blanking period BP and a low voltage level during the frame period FP, and is configured to turn on the transistor ET4 to output the data voltage to the data line DL. The selection signal SE3 has a low voltage level during the blanking period BP and is configured to turn on the transistor ET3 to transmit the threshold voltage information VDEC to the data driver 130. The selection signal SE3 has a high voltage level during the frame period FP. During the data writing period P31, the scan signal S(N) has a low voltage level. In the following, how the display panel 100 is operated is described in detail.

The operation of the display panel 100 is described in detail below. Referring to FIGS. 3A to 3D, FIGS. 3A to 3D are schematic diagrams illustrating the operation of the threshold voltage compensation circuit according to the embodiment of FIG. 1. For the ease of illustrating the operation of a threshold voltage compensation circuit 310, only one pixel PX is shown in a pixel column 320 from FIGS. 3A to 3D. Besides, in FIGS. 3A to 3D, a switch or a transistor that is turned off is marked with "X", and a switch or a transistor that is turned on is shown without the marking of "X".

Figure 3A:
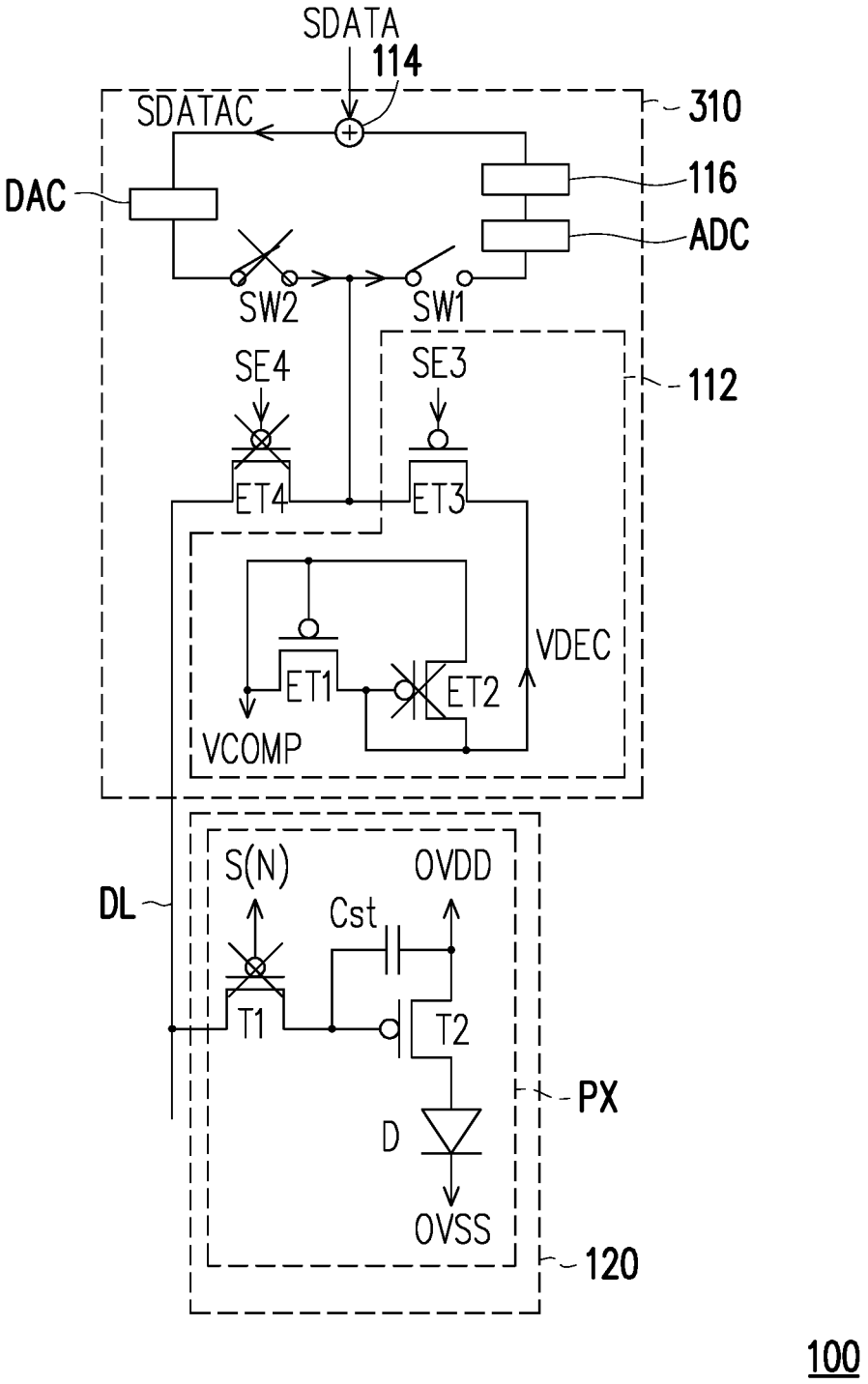
FIGS. 3A to 3D are schematic diagrams illustrating an operation of a threshold voltage compensation circuit according to the embodiment of FIG. 1.
Figure 3B:
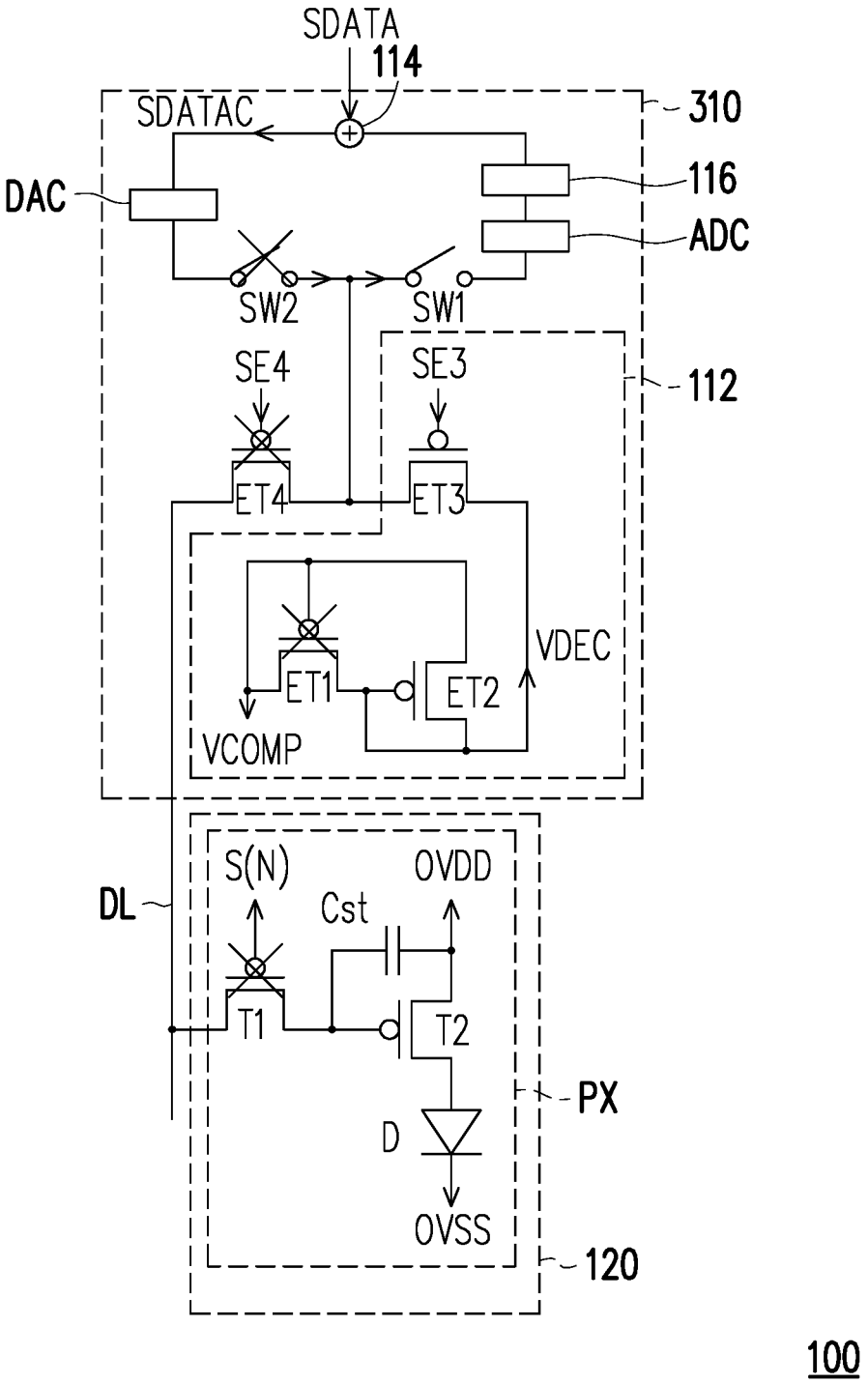
Figure 3C:
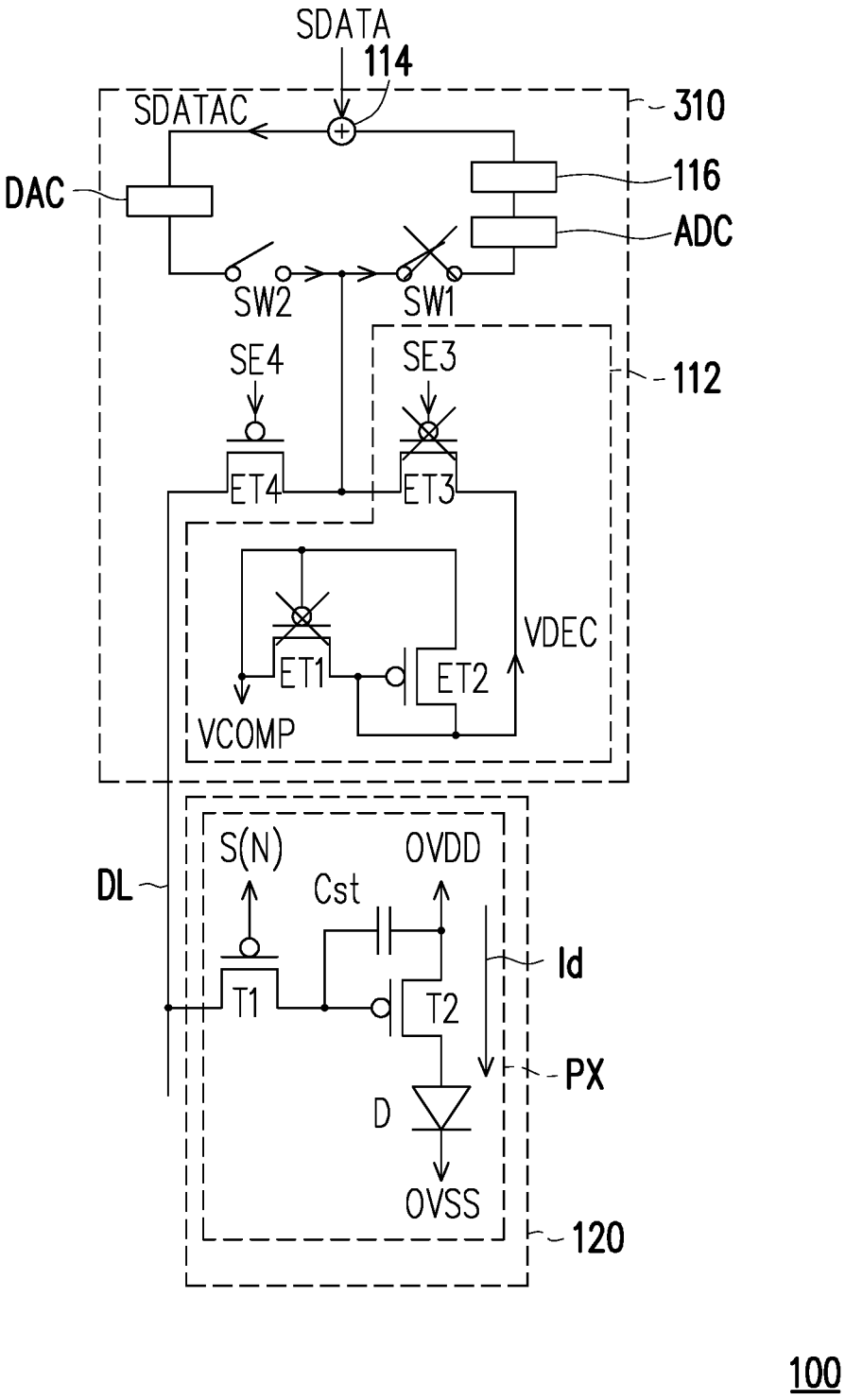
Figure 3D:
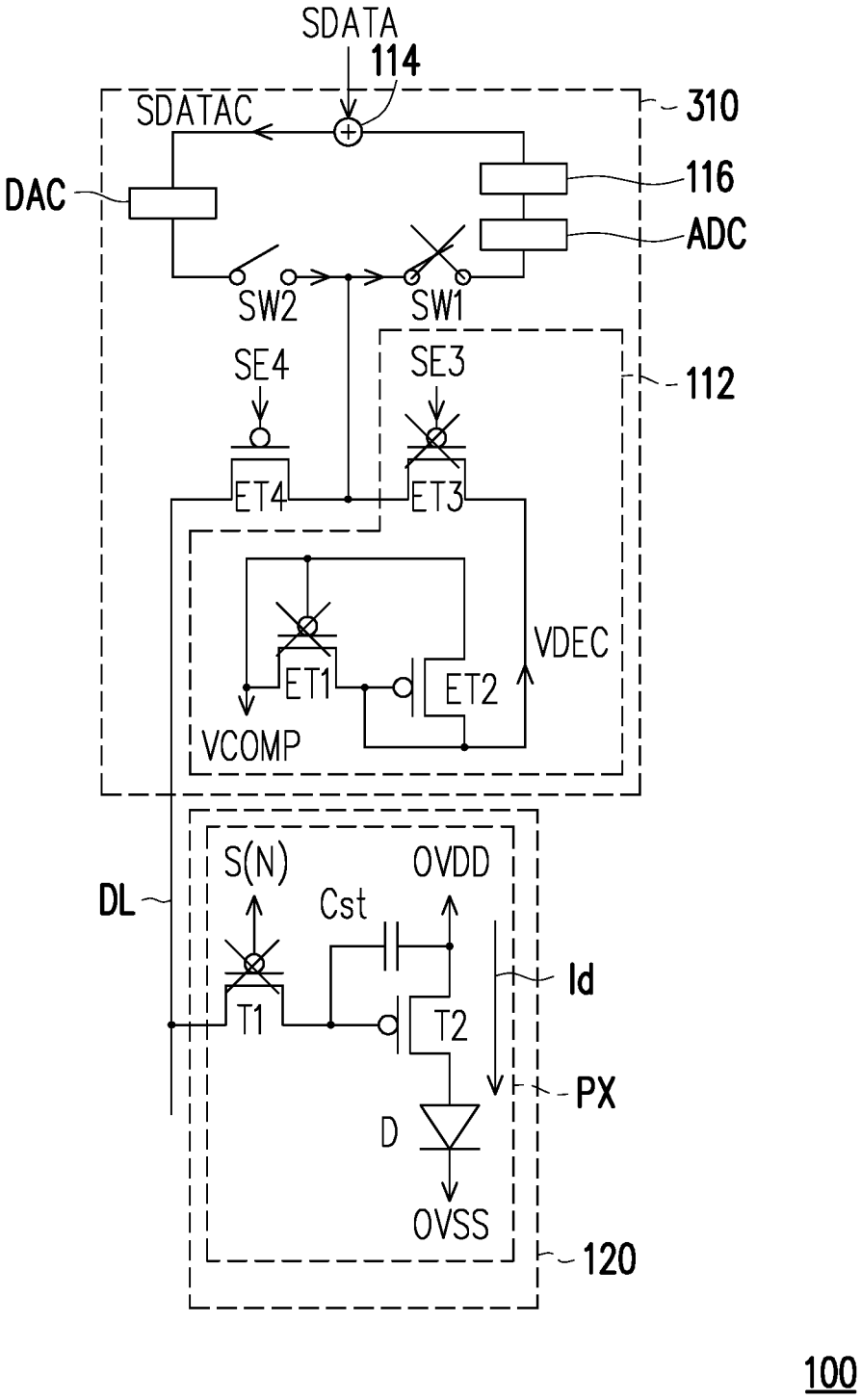

FIG. 3A is a schematic diagram illustrating a circuit operation of the embodiment of FIG. 1 during the reset period P1. FIG. 3B is a schematic diagram illustrating a circuit operation of the embodiment of FIG. 1 during the preset period P2. FIG. 3C is a schematic diagram illustrating a circuit operation of the embodiment of FIG. 1 during the data writing period P31. FIG. 3D is a schematic diagram illustrating a circuit operation of the embodiment of FIG. 1 during the emitting period P32. Referring to FIG. 3A, during the reset period P1, the display panel 100 just enters the blanking period in a booting state. In the period, the compensation voltage VCOMP has the low voltage level VL, the transistor ET1 is turned on, and the transistor ET2 is turned off. Under the circumstance, a voltage level at the control end of the transistor ET2 is $VL+|V_{TH_ET1}|$.

Referring to FIG. 3B, in the preset period P2, the compensation voltage VCOMP is turned from the low voltage level VL to the high voltage level VH, the selection signal SE3 is at the low voltage level to turn on the transistor ET3. In the period, the transistor ET1 is turned off, and the transistor ET2 and the transistor ET3 are turned on. Under the circumstance, the voltage level at the control end of the transistor is $VH-|V_{TH_ET2}|$, and a voltage level of the output threshold voltage information VDEC is consequently $VH-|V_{TH_ET2}|$. Since the switch SW1 is turned on, the threshold voltage information VDEC may be stored in the memory 116.

Then, referring to FIG. 3C, after entry of the frame period, the selection signal SE3 is at the high voltage level to turn off the transistor ET3. In other words, when entering the frame period, the threshold voltage of the transistor ET2 is not under detection. During the data writing period P31 of the each pixel refresh period P3, computation on the received display data SDATA and the threshold voltage information VDEC is carried out to generate the compensated display data SDATAC. The operator 114 is coupled to the digital-to-analog converter DAC to convert the compensated display data SDATAC in the form of digital signal into the data voltage VDATA in the form of analog signal. The pin of the data driver outputs the data voltage VDATA. Under the circumstance, the switch SW2 is turned on, so the data voltage may be output to the data line DL. The transistor T1 is turned on based on the scan signal S(N) output by the scan driver 140 to write the data voltage to the control end of the transistor T2. Under the circumstance, the voltage level at the control end of the transistor T2 is $VH-|V_{TH_ET2}|+VDATA$, wherein VDATA is the voltage level of the data voltage. Meanwhile, since the transistor T2 is operated in a saturation region due to a voltage level setting, a current Id flowing through the transistor T2 is $OVDD-(VH-|V_{TH_ET2}|+VDATA)-|V_{TH_ET2}|$, and the threshold voltage information of the transistor T2 may be cancelled out. Therefore, the current Id flowing through the transistor T2 and the light emitting diode D is only related to the data voltage VDATA.

Referring to FIG. 3D, during the emitting period P32 of each pixel refresh period P3, even though the transistor T1 is turned off, the transistor T2 may be constantly turned on for the light emitting diode D to emit light. By disposing the threshold voltage detection circuit 112 in the periphery region SA of the display panel 100 and detecting and compensating the threshold voltage during the blanking period when the display panel 100 is booting and does not enter the frame period, the emitting period in each pixel refresh period is increased, the display quality of the display panel 100 is facilitated, and the aperture rate of the pixel PX also becomes higher.

Figure 4A:
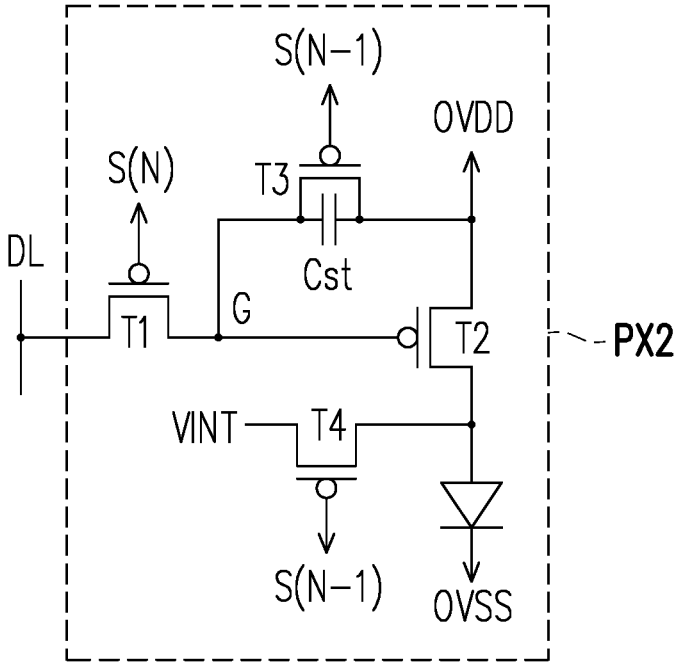
FIG. 4A is a circuit diagram of a pixel according to another embodiment of the invention.
Figure 4B:
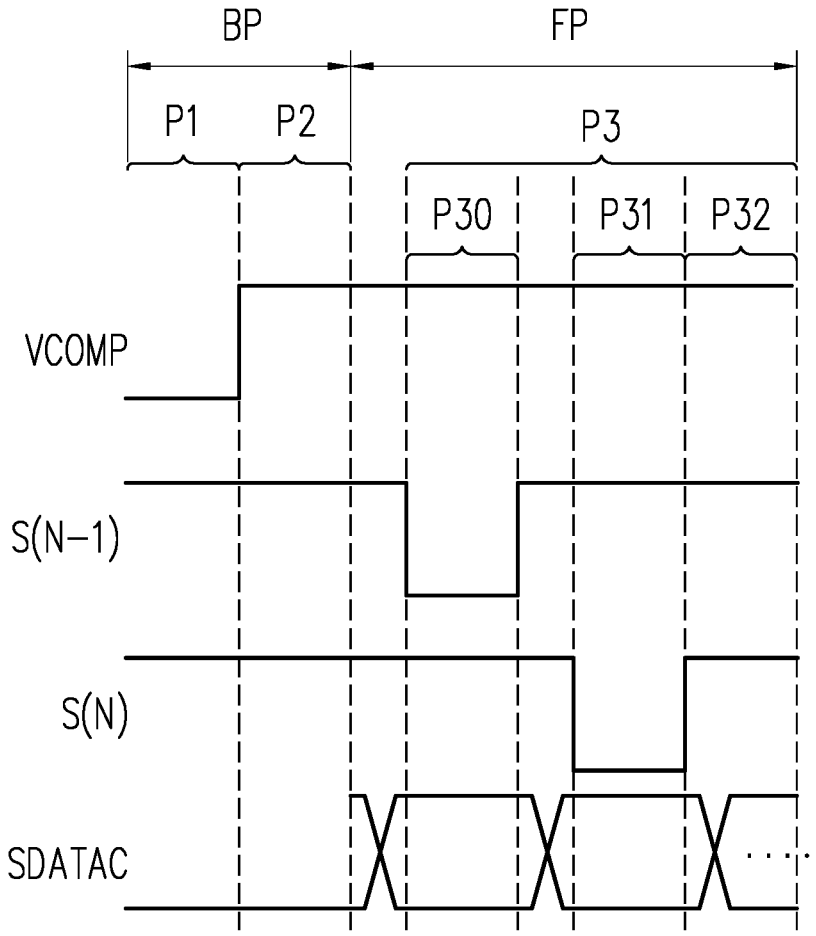
FIG. 4B is a timing diagram according to a pixel PX2 of FIG. 4A.

Referring to FIGS. 4A and 4B, FIG. 4A is a circuit diagram of a pixel according to another embodiment of the invention, and FIG. 4B is a timing diagram according to a pixel PX2 of FIG. 4A. Referring to FIG. 4A, compared with the pixel shown in FIG. 2A according to an embodiment of the invention, each pixel PX2 may further include a transistor T3 and a transistor T4. Each transistor has a first end, a second end, and a control end. The transistor T3 is connected between two ends of the capacitor Cst to reset voltage levels at the two ends of the capacitor Cst. The first end of the transistor T4 is configured to receive an initial voltage VINT, the second end of the transistor T4 is coupled to the anode of the light emitting diode D to reset a voltage level at the anode of the light emitting diode D. The control ends of the transistor T3 and the transistor T4 are commonly controlled by the scan signal S(N−1). By disposing the transistor T3 and the transistor T4, a voltage level of a node in the pixel PX2 may be reset before the data voltage is written into the pixel PX2. Then, referring to FIG. 4B, each pixel refresh period P3 may further include a reset period P30 preceding the data writing period P31. Accordingly, the voltage level of the node in the pixel PX2 may be reset before the data voltage is written to the pixel PX2. Other connections and operations of the transistors in the pixel circuit are substantially the same as those of the pixel PX2, and thus will not be repeated in the following.

Figure 5:
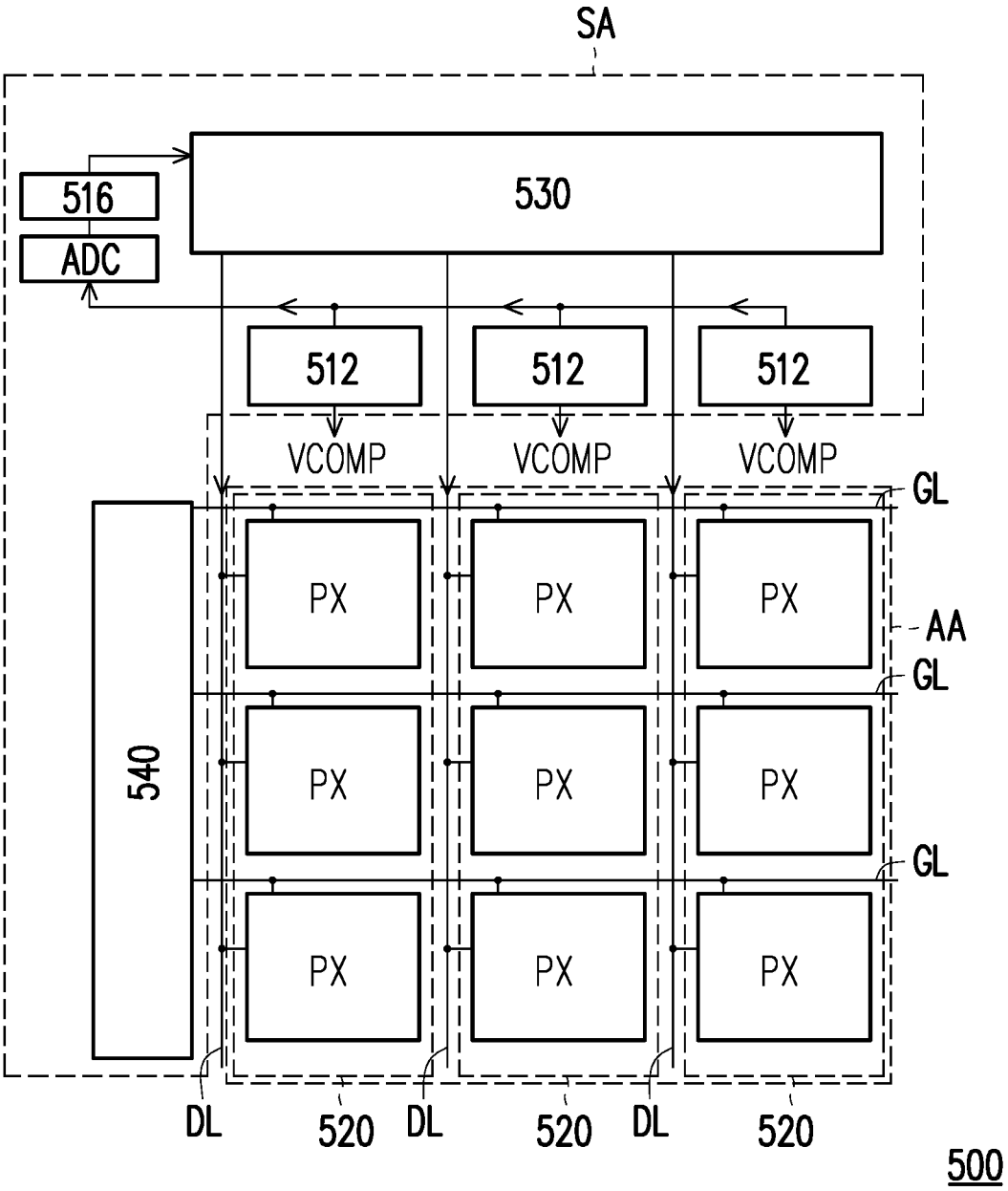
FIG. 5 is a schematic diagram illustrating a display panel 500 according to another embodiment of the invention.

FIG. 5 is a schematic diagram illustrating a display panel 500 according to another embodiment of the invention. In the embodiment of FIG. 5, the analog-to-digital converter ADC and a memory 516 may be disposed in the periphery region SA, and an adder may be disposed in a data driver 530. The threshold voltage data information VDEC received through the analog-to-digital converter ADC is converted from an analog signal to a digital signal and is temporarily stored in the memory 516. Then, through an input pin (not shown) of the data driver 530, the threshold voltage information VDEC temporarily stored in the memory 516 is transmitted to the data driver 530, and computation on the threshold voltage information VDEC and the display data SDATA is carried out to generate the compensated display data SDATAC. Afterwards, the compensated display data SDATAC is converted from a digital signal to the data voltage VDATA as an analog signal by the digital-to-analog converter DAC in the data driver 530.

Figure 6:
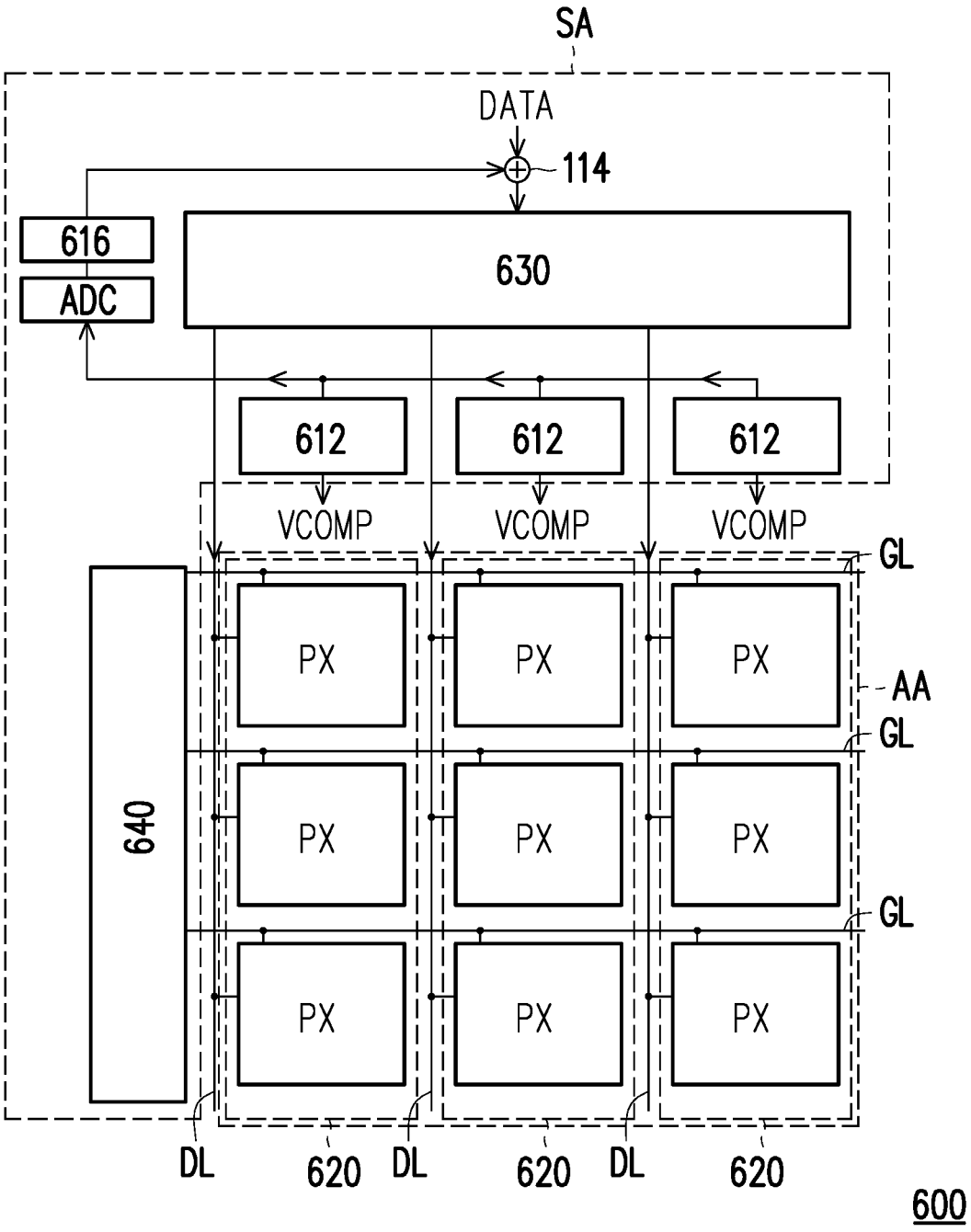
FIG. 6 is a schematic diagram illustrating a display panel according to another embodiment of the invention.

FIG. 6 is a schematic diagram illustrating a display panel 600 according to another embodiment of the invention. In the embodiment of FIG. 6, an adder 614, the analog-to-digital converter ADC, and a memory 616 may be disposed in the periphery region SA. Computation on the threshold voltage information VDEC temporarily stored in the memory 616 and the display data SDATA is carried out to generate the compensated display data SDATAC. Then, the compensated display data SDATAC is transmitted to a data driver 630 via an input pin (not shown) of the data driver 630. The remaining operations are similar to those of the display panel 100 and the display panel 500 and thus will not be repeated in the following.

In view of the foregoing, in the threshold voltage compensation circuit according to the embodiments of the invention, the compensation transistor is reset and outputs the threshold voltage information, and the operator receives the threshold voltage information and computes based on the threshold voltage information and the display data to generate the compensated display data. Accordingly, the threshold voltages of the driving transistors in the respective pixel columns may be compensated based on the compensated display data, so as to effectively facilitate the display uniformity of the display panel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, having a periphery region and a display region and comprising:

a pixel column, disposed in the display region and having a plurality of pixels coupled to a data line;

a threshold voltage compensation circuit, disposed in the periphery region and comprising:

a threshold voltage detection circuit, electrically coupled to the data line and comprising:

a first transistor, having a first end, a second end, and a control end, wherein the first end of the first transistor and the control end of the first transistor are configured to receive a compensation voltage;

a compensation transistor, outputting threshold voltage information of the compensation transistor based on the compensation voltage and having a first end, a second end, and a control end, wherein the second end of the first transistor is coupled to the control end of the compensation transistor, the control end of the first transistor is coupled to the second end of the compensation transistor, and the first end of the compensation transistor is coupled to the control end of the compensation transistor; and a second transistor, having a first end, a second end, and a control end, wherein the first end of the compensation transistor is coupled to the first end of the second transistor; and an operator, electrically coupled to the threshold voltage detection circuit and configured to generate compensated display data based on the threshold voltage information and display data.

2. The display panel as claimed in claim 1, wherein the threshold voltage compensation circuit further comprises:

an analog-to-digital converter, electrically coupled to the threshold voltage detection circuit and configured to convert the threshold voltage information from a form of analog signal to a form of digital signal; and a memory, coupled to the analog-to-digital converter and configured to temporarily store the threshold voltage information.

3. The display panel as claimed in claim 1, wherein the threshold voltage compensation circuit comprises:

turning on the first transistor based on the compensation voltage having a first voltage level during a reset period; and turning off the first transistor and turning on the compensation transistor based on the compensation voltage having a second voltage level during a preset period to output the threshold voltage information.

4. The display panel as claimed in claim 3, wherein the threshold voltage compensation circuit further comprises:

turning on the second transistor based on a first control signal during the preset period.

5. The display panel as claimed in claim 1, wherein the threshold voltage compensation circuit further comprises:

a first switch, electrically coupled between the second transistor and the operator, wherein the first switch is turned on during a preset period and configured to transmit the threshold voltage information to the operator; and a second switch, electrically coupled between the operator and the data line, wherein the second switch is turned on during a pixel refresh period and configured to output the data voltage, wherein the first switch and the second switch are not turned on at the same time.

6. The display panel as claimed in claim 1, wherein each of the pixels comprises:

a fourth transistor, having a first end, a second end, and a control end, wherein the first end of the fourth transistor is coupled to the data line, and the control end of the fourth transistor is configured to receive a first scan signal;

a driving transistor, having a first end, a second end, and a control end, wherein the first end of the driving transistor is configured to receive a first supply voltage, and the control end of the driving transistor is electrically coupled to the second end of the fourth transistor;

a capacitor, coupled between the first end and the control end of the driving transistor; and a light emitting diode, wherein an anode of the light emitting diode is coupled to the second end of the driving transistor, and a cathode of the light emitting diode is configured to receive the second supply voltage.

7. The display panel as claimed in claim 6, wherein each of the pixels further comprises:

a fifth transistor, having a first end, a second end, and a control end, wherein the first end of the fifth transistor and the second end of the fifth transistor are coupled to two ends of the capacitor, and the control end of the fifth transistor is configured to receive a second scan signal; and a sixth transistor, having a first end, a second end, and a control end, wherein the first end of the sixth transistor is coupled to the anode, the control end of the sixth transistor is configured to receive the second scan signal, and the first end of the sixth transistor is configured to receive a reference voltage.

8. A threshold voltage compensation circuit, disposed in a periphery region, the threshold voltage compensation circuit comprising:

a threshold voltage detection circuit, electrically coupled to a data line of the display panel and comprising:

a first transistor, having a first end, a second end, and a control end, wherein the first end of the first transistor and the control end of the first transistor are configured to receive a compensation voltage;

a compensation transistor, outputting threshold voltage information of the compensation transistor based on the compensation voltage and having a first end, a second end, and a control end, wherein the second end of the first transistor is coupled to the control end of the compensation transistor, the control end of the first transistor is coupled to the second end of the compensation transistor, and the first end of the compensation transistor is coupled to the control end of the compensation transistor; and a second transistor, having a first end, a second end, and a control end, wherein the first end of the compensation transistor is coupled to the first end of the second transistor; and an operator, electrically coupled to the threshold voltage detection circuit and configured to generate compensated display data based on the threshold voltage information and display data.

9. The threshold voltage compensation circuit as claimed in 8, wherein the threshold voltage compensation circuit further comprises:

an analog-to-digital converter, electrically coupled to the threshold voltage detection circuit and configured to convert the threshold voltage information from a form of analog signal to a form of digital signal; and a memory, coupled to the analog-to-digital converter and configured to temporarily store the threshold voltage information.

10. The threshold voltage compensation circuit as claimed in 8, wherein the threshold voltage compensation circuit is configured to:

turn on the first transistor based on the compensation voltage having a first voltage level during a reset period; and turn off the first transistor and turning on the compensation transistor based on the compensation voltage having a second voltage level during a preset period to output the threshold voltage information.

11. The threshold voltage compensation circuit as claimed in 10, further comprising:

turning on the second transistor based on a first control signal during the preset period.

12. The threshold voltage compensation circuit as claimed in 8, further comprising:

a first switch, electrically coupled between the second transistor and the operator, wherein the first switch is turned on during a preset period and configured to transmit the threshold voltage information to the operator; and a second switch, electrically coupled between the operator and the data line, wherein the second switch is turned on during a pixel refresh period and configured to output the data voltage, wherein the first switch and the second switch are not turned on at the same time.

* * * * *